US005799731A

United States Patent [19]

Avakov et al.

[11] Patent Number: 5,799,731

[45] Date of Patent: Sep. 1, 1998

[54] TUBING GUIDE WITH OPTIMIZED PROFILE AND OFFSET

[75] Inventors: Vladimir A. Avakov, Duncan, Okla.; William D. Taliaferro, DeSoto, Tex.

[73] Assignee: Halliburton Company, Duncan, Okla.

[21] Appl. No.: 632,788

[22] Filed: Apr. 17, 1996

[51] Int. Cl.[6] ..... E21B 19/22

[52] U.S. Cl. ..... 166/77.2; 166/85.5

[58] Field of Search ..... 166/77.2, 77.3, 166/85.5, 380, 85.1

[56] References Cited

U.S. PATENT DOCUMENTS

| | | | |
|---|---|---|---|
| 3,116,793 | 1/1964 | McStravick | 166/77.2 X |
| 3,827,487 | 8/1974 | Jackson et al. | 166/77.3 |
| 4,515,220 | 5/1985 | Sizer et al. | 166/384 |
| 4,585,061 | 4/1986 | Lyons, Jr. et al. | 166/77.3 |
| 4,655,291 | 4/1987 | Cox | 166/385 |
| 4,743,175 | 5/1988 | Gilmore | 166/77.2 X |
| 5,088,559 | 2/1992 | Taliaferro | 166/379 |
| 5,094,340 | 3/1992 | Avakov | 198/626.1 |
| 5,234,053 | 8/1993 | Connell | 166/250 |
| 5,244,046 | 9/1993 | Council et al. | 166/380 |
| 5,279,364 | 1/1994 | Jantzen et al. | 166/77 |
| 5,309,990 | 5/1994 | Lance et al. | 166/77 |
| 5,553,668 | 9/1996 | Council et al. | 166/77.3 |

OTHER PUBLICATIONS

Otis Engineering Corporation Products and Services Catalog, 1989, pp. 284–290.

Photographs 1, 2, 3 and 4 of a prior art apparatus.

*Primary Examiner*—Frank Tsay

*Attorney, Agent, or Firm*—Stephen R. Christian; Anthony L. Rahhal

[57] ABSTRACT

An apparatus for guiding and directing tubing into a coiled tubing injector apparatus is disclosed. The tubing guide will direct the tubing into the coiled tubing injector apparatus for insertion or removal into the wellbore therebelow. The natural, or residual radius of the tubing is utilized to direct the tubing into the coiled tubing injector apparatus, so that minimal bending is applied to the tubing.

21 Claims, 8 Drawing Sheets

TUBING GUIDE WITH OPTIMIZED PROFILE AND OFFSET

BACKGROUND OF THE INVENTION

This invention relates to a gooseneck, which is also referred to as a tubing guide, and more particularly to a tubing guide for directing coiled tubing into a coiled tubing injector apparatus. Reeled or coiled tubing has been run into completed wells for many years for performing certain downhole operations. Those operations include, but are not limited to, washing out sand bridges, circulating treating fluids, setting downhole tools, cleaning the internal walls of well pots, conducting producing fluids or lift gas, and a number of other similar remedial or production operations. The tubing utilized for such operations is generally inserted into the wellhead through a lubricator assembly or stuffing box. Typically, there is a pressure differential on the well so that the well is a closed chamber producing oil or gas or a mixture thereof from the pressurized well. The tubing that is inserted into the well is normally inserted through a lubricator mechanism which seals the well for pressure retention in the well.

The tubing is flexible and can bend around a radius of curvature and is normally supplied on a drum or reel. The tubing is spooled off of the reel and inserted into a coiled tubing injector assembly. The coiled tubing injector assembly essentially comprises a curvilinear gooseneck, or tubing guide and a coiled tubing injector apparatus positioned therebelow.

The curvilinear tubing guide forms an upper portion of the injector assembly while the coiled tubing injector apparatus forms a lower portion thereof. Most coiled tubing injector apparatus utilize a pair of opposed inlet drive chains arranged in a common plane. Such drive chains are made up of links, rollers and gripper blocks. The drive chains are generally driven by sprockets powered by a motor which is a reversible hydraulic motor. The opposed drive chains grip the coiled tubing between them. The drive chains are backed up by linear beams, also referred to as pressure beams, so that a number of pairs of opposed gripping blocks are in gripping engagement with the tubing at any given moment. Coiled tubing injector apparatus are shown in U.S. Pat. No. 5,094,340 to Avakov, which is incorporated herein by reference for all purposes, and U.S. Pat. No. 4,655,291 to Cox, which is likewise incorporated herein for all purposes.

A typical tubing guide has a curvilinear first frame portion with a set of rollers thereon which support and guide the tubing as it is moved through the injector. Spaced from the first frame portion is a second frame portion also having a set of rollers thereon which are on the opposite side of the tubing from the first set of rollers and which also act to guide the tubing. The tubing guide is pivotable for easy alignment with the tubing reel. The radius of curvature of the typical tubing guide is constant and is typically smaller than the residual or natural radius of curvature of the coiled tubing in its free state after it has been spooled off the reel. The rollers therefore force the tubing to bend to match the curvature of the tubing guide and to straighten the tubing so that it is substantially vertical when it exits the tubing guide and enters the coiled tubing injector apparatus therebelow. The bending and stresses experienced by the tubing each time it is deformed or bent and injected into the well decrease the life of the coiled tubing.

SUMMARY OF THE INVENTION

The tubing guide of the present invention is an improvement over prior art tubing guides in that it directs coiled tubing into a substantially vertical, or injection position with reduced bending and reduced stresses thereby increasing the life of the coiled tubing. The tubing guide of the present invention also simplifies stubbing of the coiled tubing into the coiled tubing injector apparatus by utilizing the natural curvature of the tubing and allows for reduced overall injector assembly size and weight.

The tubing guide of the present invention generally comprises a base and a primary carrier extending upward from the base. The primary carrier is comprised of a curvilinear primary carrier arm with a plurality of rollers attached thereto.

In a preferred embodiment, the primary carrier has a plurality of arcuately shaped portions, and preferably three arcuately shaped portions including an upper approach, or entry portion defined by a first radius, a center or load portion defined by a second radius, and an exit portion defined by a third radius. The second radius of curvature is generally greater in magnitude than the first and third radius which are, in a preferred embodiment, of equal magnitude. The radius of curvature of each portion is defined or circumscribed by the center of the rollers attached to the primary carrier arm.

The tubing guide of the present invention also includes an offset contact point positioned above the base. The offset contact point is defined on one of the rollers, designated as an offset roller, attached to the primary carrier arm. The offset roller is offset from a center line of the coiled tubing injector apparatus positioned therebelow, and is thus positioned so that the coiled tubing passing thereover is likewise laterally offset from the center line of the coiled injector apparatus. The center line of the coiled tubing injector apparatus is co-linear with a center line of the wellbore therebelow. The offset roller is positioned so that the natural, or residual curvature of the tubing will cause the tubing to traverse the lateral distance between the offset roller and the center line of the coiled tubing injector apparatus as the tubing passes through a vertical distance between the offset roller and an engagement point defined on the coiled tubing injector apparatus. The engagement point is the point at which the outer diameter of the tubing is engaged by the coiled tubing injector apparatus, and will normally be the point at which the linear beams, or pressure beams in the coiled tubing injector apparatus become substantially vertical.

Thus, a line tangent to the coiled tubing at the location where it passes over the offset roller lies at an angle to the center line of the coiled tubing injector apparatus and the wellbore therebelow. The natural curvature of the tubing is such that the tubing is substantially vertical when it reaches the engagement point. Thus, a line tangent to the tubing at the engagement point will be substantially parallel to the center line of the coiled tubing apparatus and the wellbore therebelow.

BRIEF DESCRIPTION OF THE DRAWINGS

FIG. 17 is a schematic of the tubing guide of the present invention showing the radius of curvature of the arcuately shaped portions of the tubing guide.

DESCRIPTION OF THE PREFERRED EMBODIMENTS

Figure 1:
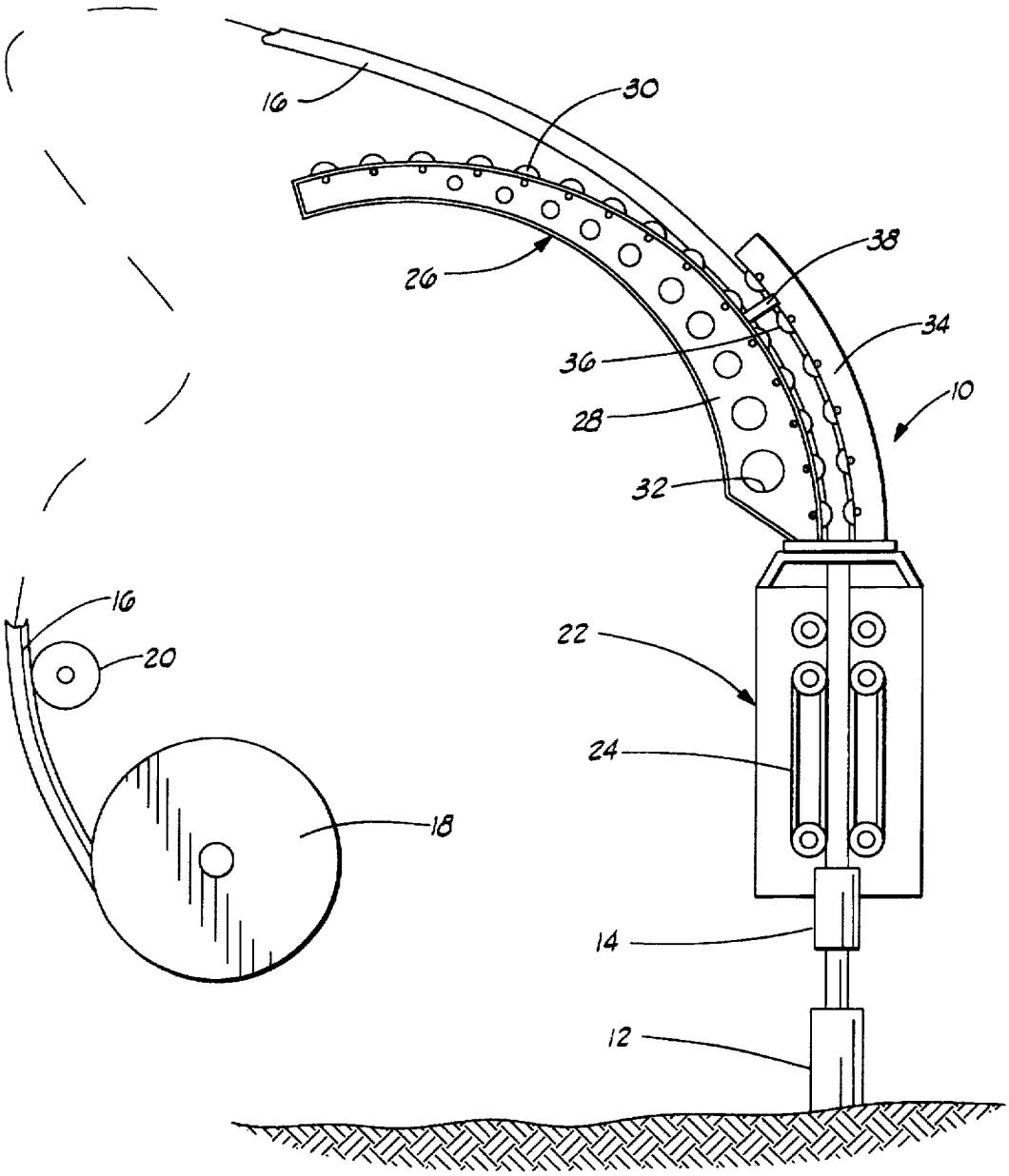
FIG. 1 PRIOR ART
FIG. 1 shows a side elevational schematic of a prior art tubing injector.
Figure 2:
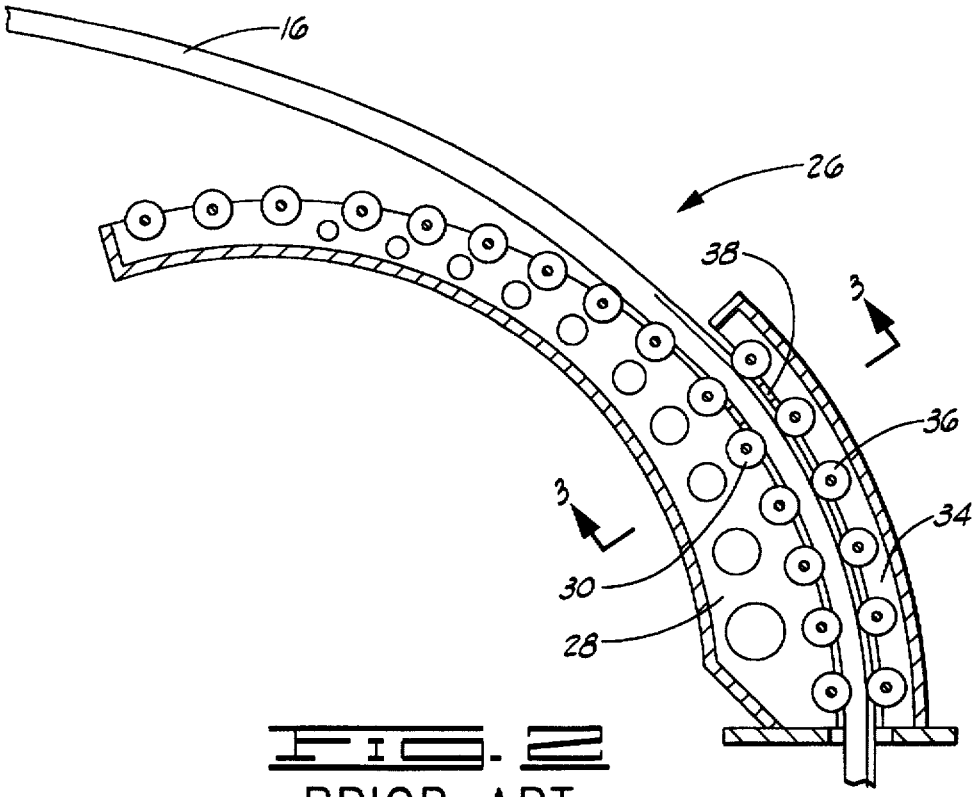
FIG. 2 PRIOR ART
FIG. 2 is a vertical cross section of the tubing guide apparatus of the prior art tubing injector.
Figure 3:
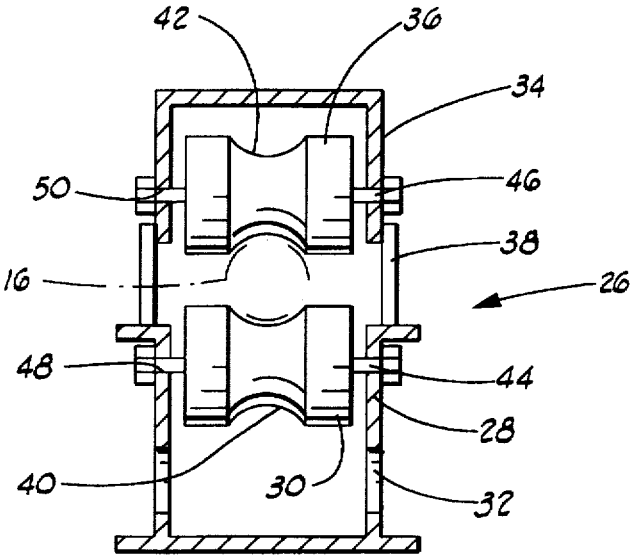
FIG. 3 PRIOR ART
FIG. 3 shows a prior art cross section taken along lines 3—3 in FIG. 2.

Referring now to the drawings, and more particularly to FIGS. 1–3, a prior art coiled tubing injector assembly is shown and generally designated by the numeral 10. The assembly 10 is positioned over a wellhead 12 which is provided with a stuffing box or lubricator 14. Tubing 16 is provided to assembly 10 on a large drum or reel 18, and typically is several thousand feet in length. Tubing 16 has a longitudinal central axis 15 and an outer diameter, or surface, 17. The tubing is in a relaxed, but coiled, stated when supplied from drum or reel 18. The tubing has a natural, or residual radius of curvature when it is in its relaxed state after being spooled from the reel.

The well is typically pressure isolated. That is, entry of tubing 16 into the well must be through stuffing box 14 which enables the tubing, which is at atmospheric pressure, to be placed in the well which may operate at higher pressures. Entry into the well requires that the tubing be substantially straight. To this end, the assembly 10 incorporates a coiled tubing injector apparatus 22 which is constructed with drive chains which carry blocks adapted for gripping tubing 16. The details of drive chains and blocks 24 are known in the art. See for example, U.S. Pat. No. 5,094,340 entitled "GRIPPER BLOCKS FOR REELED TUBING INJECTORS," the details of which have been incorporated herein by reference.

A tubing guide 26 is attached to the upper end of coiled tubing injector apparatus 22. Typically, tubing guide 26 is pivotable about a vertical axis with respect to the injector 22 positioned therebelow. Tubing guide 26 includes a curvilinear first or bottom frame 28 having a plurality of first or bottom rollers 30 rotatably disposed thereon. Bottom frame 28 includes a plurality of lightening holes 32 therein.

Spaced from bottom frame 28 is a second or top frame 34 which has a plurality of second or top rollers 36 rotatably disposed thereon. Top rollers 36 generally face at least some of bottom rollers 30. In the embodiment illustrated, the length of curvilinear top frame 34 is less than that of curvilinear bottom frame 28. The distal end of top frame 34 is attached to bottom frame 28 by a bracket 38.

Referring now to FIG. 3, bottom rollers 30 have a circumferential groove 40 therein, and top rollers 36 have a similar circumferential groove 42 therein. Facing rollers 30 and 36 are spaced such that tubing 16 is generally received in grooves 40 and 42 to guide and straighten the tubing as it enters injector coiled tubing 22 of assembly 10. The tubing guide thus bends and straightens the tubing 16 into the vertical, or injection position.

Bottom rollers 30 are supported on first shafts 44, and similarly, top rollers 36 are supported on second shafts 46. Shafts 44 are disposed through a plurality of aligned pairs of holes 48 in bottom frame 28. Shafts 46 are disposed through holes 50 in top frame 34. Rollers 30 and 36 are supported on shafts 44 and 46, respectively, by bearings (not shown).

The prior art tubing guide, while serving its intended purpose, still has inherent difficulties. The tubing guide shown in FIG. 1 will bend and straighten the tubing so that it is vertical as it exits the tubing guide. The bending and the combination of stresses due to the pressures and loads experienced by the tubing due to straightening which occurs each time the tubing is injected, used, and/or withdrawn from the well shortens the life of the tubing.

Figures 1, 4, 10:
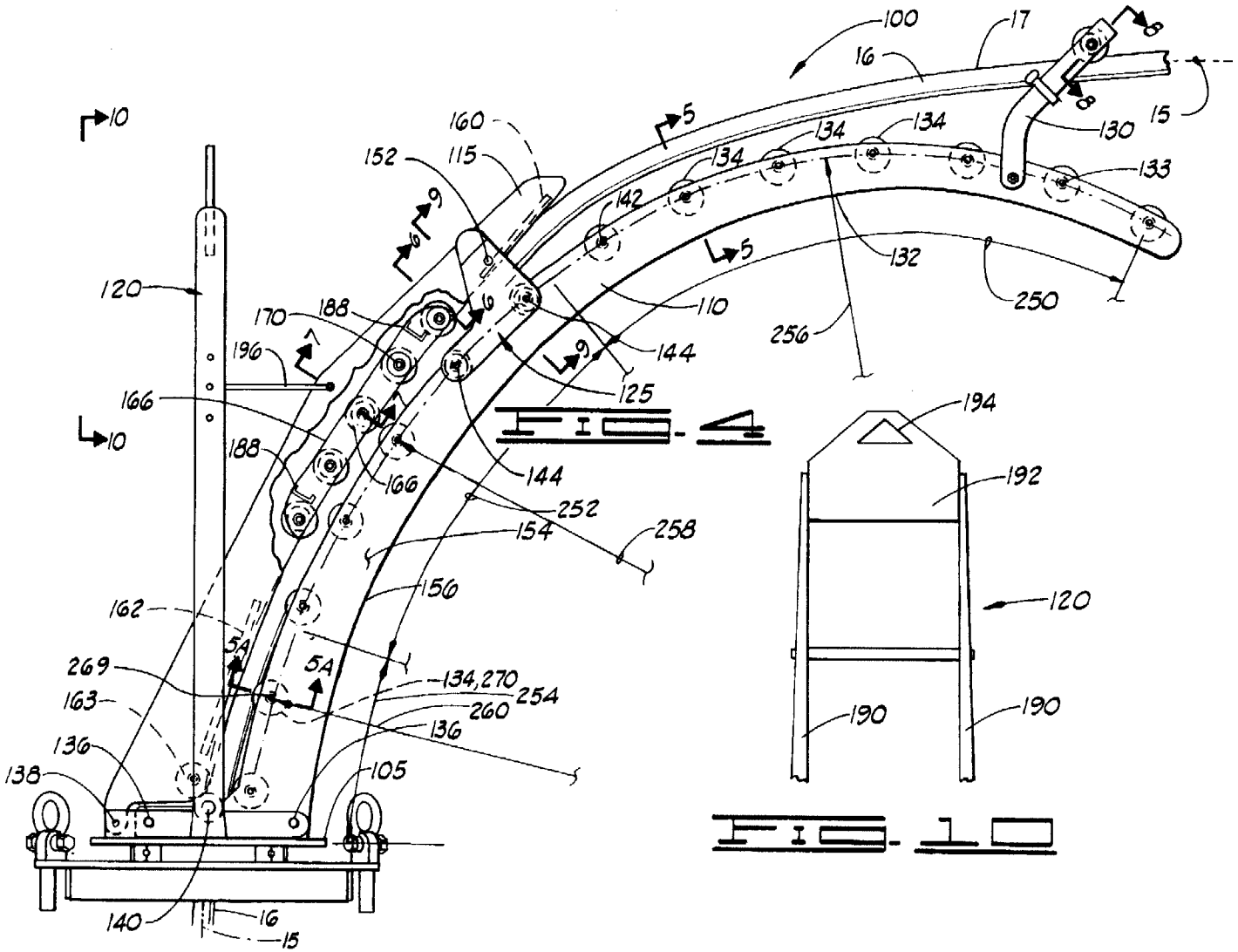
FIG. 4 is a side elevational schematic of the tubing guide of the present invention.
FIG. 10 shows a view taken from line 10—10 on FIG. 4 and shows an upper end of a lifting beam.

Referring now to FIG. 4, a tubing guide of the present invention is shown and generally designated by the numeral 100. The tubing guide includes a base 105, a primary tubing carrier 110 and a secondary tubing carrier, or back guide 115 extending upwardly therefrom. A lifting beam 120 also extends upward from the base 105. A carrier linkage 125 may be included to connect the primary tubing carrier 110 to secondary carrier 115. A tubing approach guide 130 is attached to the carrier and extends upwardly therefrom.

Primary tubing carrier 110 is comprised of a primary carrier arm 132 having a plurality of rollers 134 rotatably disposed thereon. Upper approach guide 130 also has a roller 134 attached thereto. As better shown in FIG. 5, rollers 134 have a center or longitudinal central axis 133, an outer diameter 135 and a circumferential groove 137. Primary carrier 110 is attached to base 105 with pins 136. Secondary carrier 115 is attached to base 105 with a pin 138 while the lifting beam 120 is attached with pins 140. Pins 136, 138 and 140 may be held in place with cotter pins or by any other means known in the art. The attachment to the base is better shown in FIGS. 11 and 13.

Figure 9:
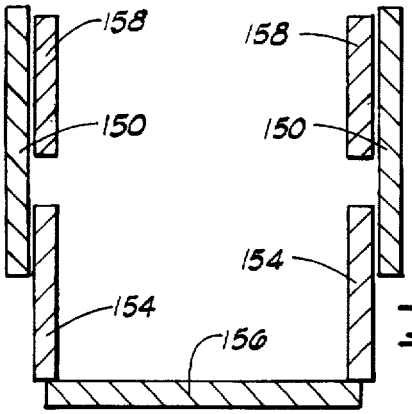
FIG. 9 shows a view taken through line 9—9 on FIG. 4.

Rollers 134 are supported on shafts 142 and 144 by bearings 146 and sleeves 148. The rollers are supported with shafts 142 at all locations along the primary carrier except at the two locations wherein carrier linkage 125 is attached. Shafts 144, which may be longer than shafts 142, but are otherwise identical thereto, are used at such locations. As shown in FIG. 9 the carrier linkage is comprised of a pair of opposed plates 150. A removable pin 152 is used to connect the carrier linkage to the secondary carrier arm. When the removable pin is not in place, the secondary carrier arm may be rotated about connecting pin 138.

Figure 5:
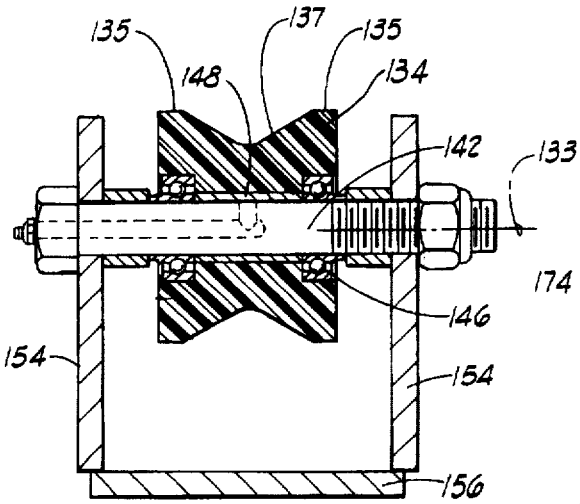
FIG. 5 shows a view taken through line 5—5 on FIG. 4.

The primary carrier arm, as better shown in FIG. 5, consists of outer plates 154 which are connected to a face plate 156. The plates may be connected by welding or other means known in the art. Secondary carrier, or back guide 115 may generally be comprised of outer plates 158 and back-up plates 160 and 162, which span between and are connected to outer plates 158 by welding or other means. Secondary carrier 115 further comprises a roller carrier 164 disposed between opposed outer plates 158, and an exit roller 163.

Exit roller 163 may be identical to rollers 134 and supported on a shaft as described with respect to rollers 134. Roller carrier 164 includes a center roller 166 and outer rollers 170. Center roller 166 and outer rollers 170 have centers, or longitudinal central axis, 163 and 167 respectively, circumferential grooves 168 and 172 respectively and outer diameters 169 and 171 respectively.

Figure 6:
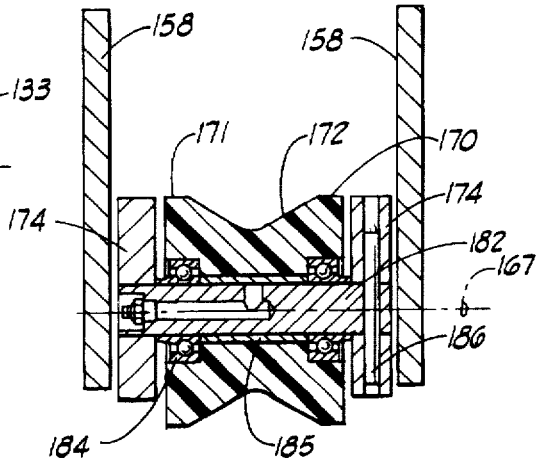
FIG. 6 shows a view taken through line 6—6 on FIG. 4.
Figure 7:
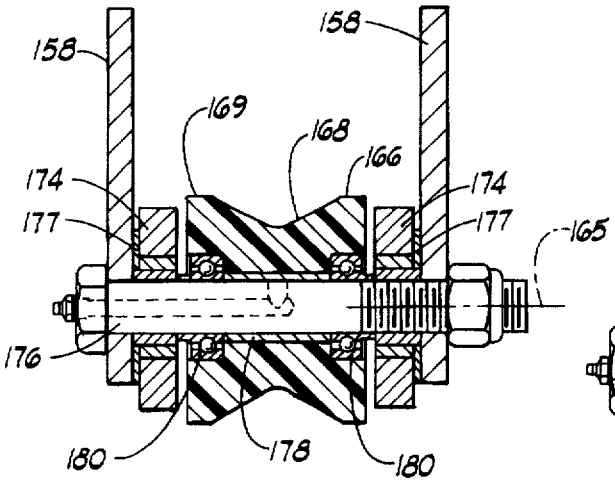
FIG. 7 shows a view taken through line 7—7 on FIG. 4.
Figure 8:
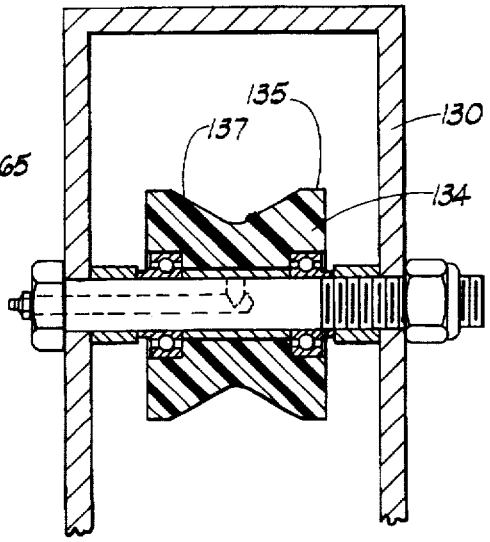
FIG. 8 shows a view taken through line 8—8 on FIG. 4.

As shown in FIGS. 6 and 7 roller carrier 164 includes outer roller carrier plates 174, and is attached to outer plates 158 with a threaded shaft 176. Center roller 166 is supported on shaft 176 by a sleeve 178 and bearings 180. Outer rollers 170 are supported on shafts 182 by bearings 184 and sleeves 185. Shafts 182 extend through plates 174 and can be affixed thereto by any means known in the art such as, but not limited to, a roll pin 186 which extends through plates 174 and shafts 182. A pair of U-shaped stiffeners 188 may be attached between outer plates 164 to provide additional strength. As described herein, the roller carrier 164 will pivot about shaft 176. A pair of thrust bearings 177 are interposed between outer plate 158 of the secondary carrier and plates 174 of the roller carrier so that there will be clearance between secondary carrier outer plates 158 and roller carrier outer plates 174 along the length of the roller carrier.

Lifting beam 120 comprises a pair of lifting beam outer plates 190 with a lifting plate 192 disposed therebetween. Lifting plate 192 includes an opening 194. A lifting beam linkage 196 may be used to connect the lifting beam with the secondary carrier. The attachment of the primary carrier, the secondary carrier and the lifting beam to the base is better seen in FIGS. 11 and 13.

Figure 11:
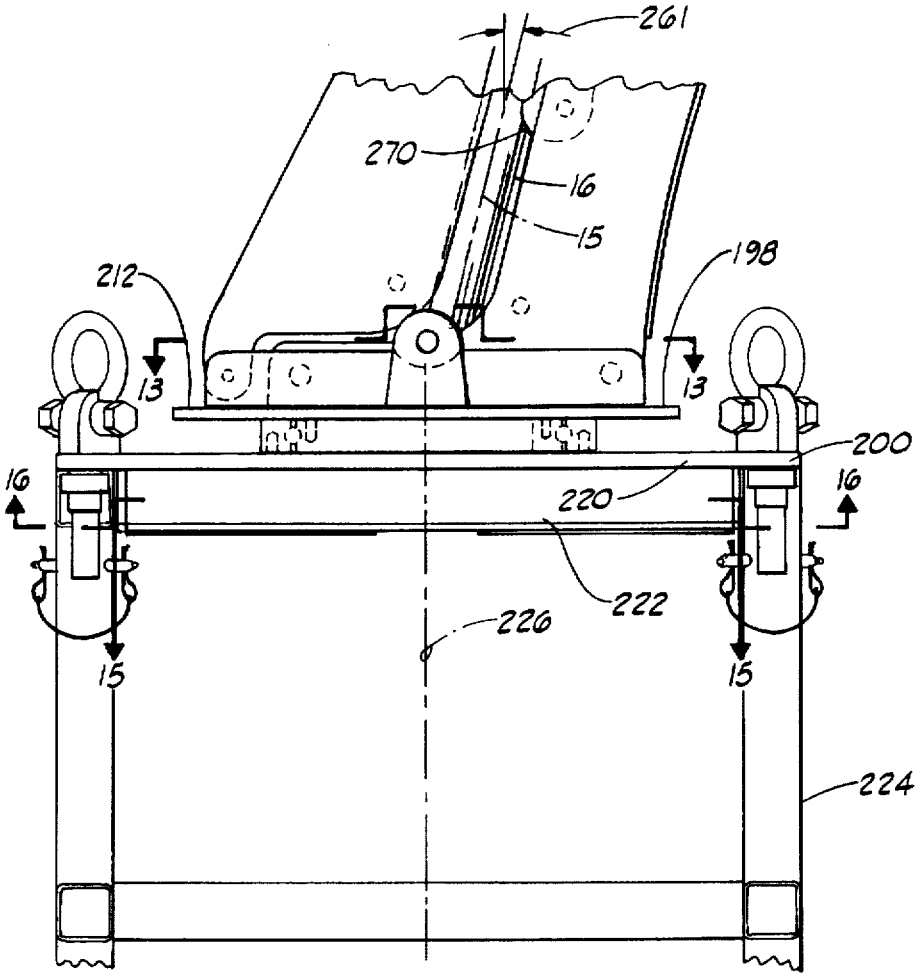
FIG. 11 shows a schematic of the base of the tubing guide of the present invention with a schematic of the upper end of the structure which houses the coiled tubing injector apparatus therebelow.
Figure 12:
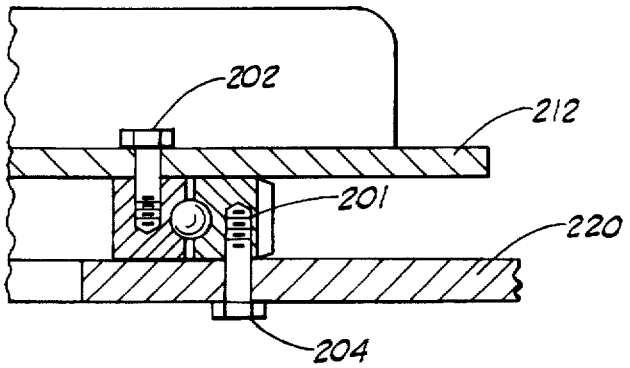
FIG. 12 shows a partial section view of the attachment of the upper base portion to the lower base portion.
Figure 13:
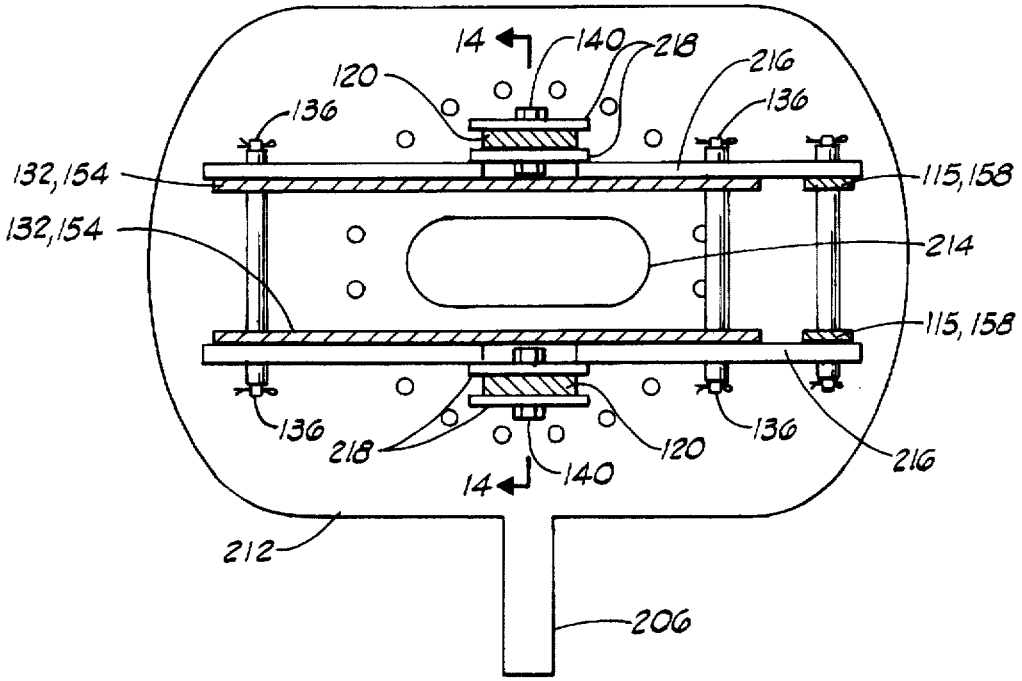
FIG. 13 shows a view looking down at the upper base portion.

Base 105 is comprised of an upper base portion 198 and a lower base portion 200. Referring now to FIG. 11, upper base portion 198 is rotatably connected to lower base portion 200 utilizing a plurality of bearings 201 which are attached to the upper and lower base portions with threaded fasteners 202 and 204, respectively. As seen in FIG. 13, the embodiment shown is adapted to utilize sixteen bearings. The bearings allow the upper base portion to rotate on the lower base portion. Thus, as viewed in FIG. 4, the base could be rotated 180° and locked in place, so that the tubing guide can be utilized in two different positions. The upper base portion may include a locking arm 206 which has a downwardly extending lug 208 having a pair of openings 210 defined therein. The lower base portion will have a mating lug extending upwardly therefrom (not shown) positioned so that bolts or pins can be inserted into openings 210 and into corresponding openings in the lug extending upwardly from the lower base portion so as to lock the arm in position.

Figure 14:
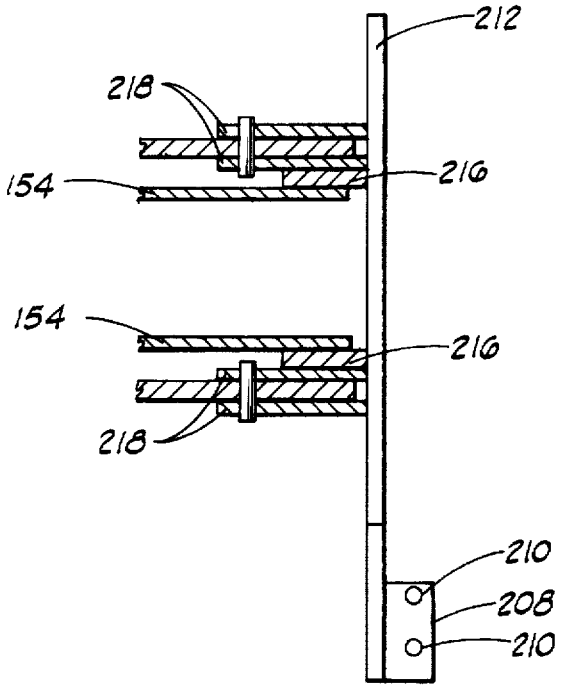
FIG. 14 shows a partial section view taken from line 14—14 of FIG. 13.
Figure 15:
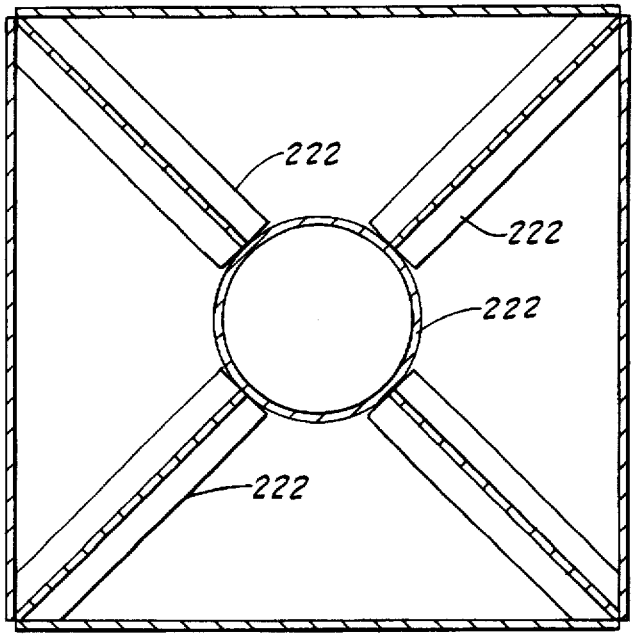
FIG. 15 shows a view taken from line 15—15 of FIG. 11 and shows the stiffeners of the lower base portion.
Figure 16:
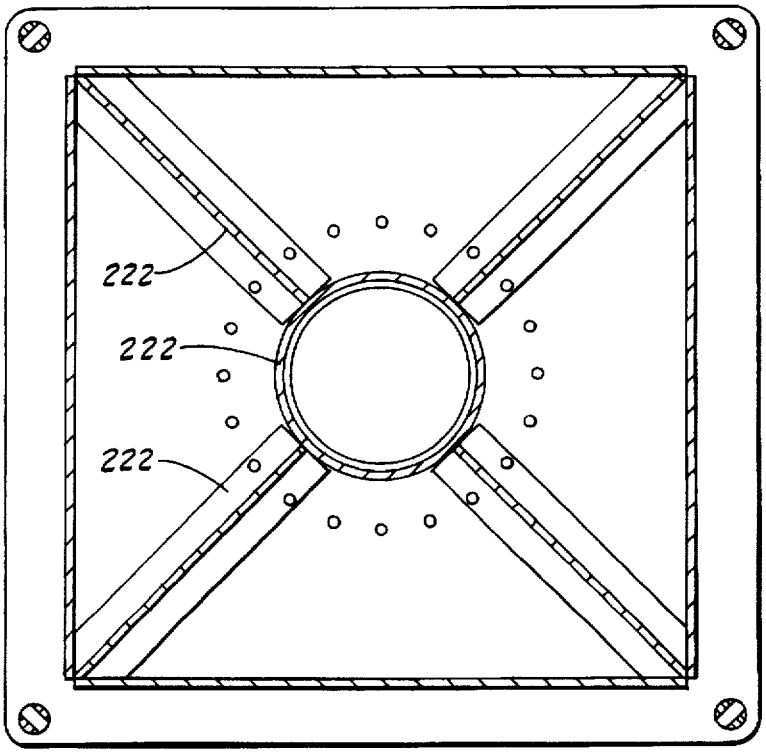
FIG. 16 shows a view taken through line 16—16 of FIG. 11.
Figures 5A, 7:
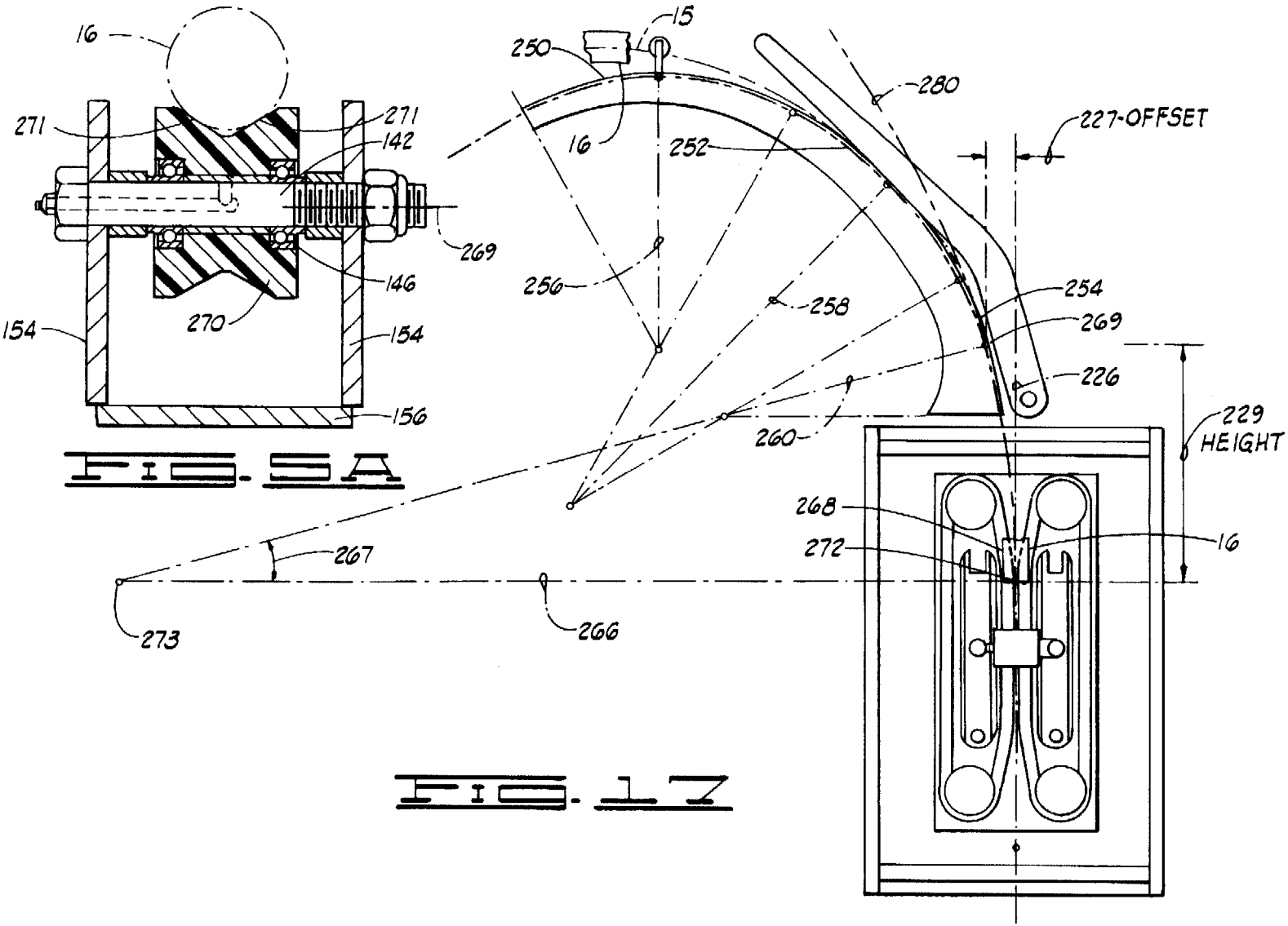
FIG. 5A shows a view taken through line 5A—5A on FIG. 11.

The upper base portion comprises an upper base plate 212 having an elongated opening 214 defined therethrough for allowing coiled tubing to pass therethrough. The upper base portion further includes a pair of legs 216 and opposed attachment lugs 218 extending upwardly therefrom. As shown in FIGS. 13 and 14, primary carrier 110 is attached to legs 216 at four locations with pins 136. Secondary carrier 115 is attached with pins 138 and lifting beam 120 is attached to lugs 218 with pins 140.

The lower base portion is comprised of lower base plate 220 having stiffeners 222 extending downwardly therefrom. As schematically shown in FIG. 11, pins at each corner of the lower base portion will extend downwardly into and be attached to a structure 224 which will house the coiled tubing injector apparatus therebelow which, in combination with the tubing guide, makes up a coiled tubing injector assembly. A center line, or longitudinal central axis, 226 of the coiled tubing injector apparatus and the wellbore below is also seen in FIG. 11. Coiled tubing injector apparatus are well known in the art and the use of the tubing guide of the present invention is not limited in any way to any particular coiled tubing injector apparatus.

Referring now to FIG. 17, a schematic showing the curvature of the tubing guide of the present invention is shown along with a schematic of a coiled tubing injector apparatus therebelow. As seen in FIG. 17, the tubing guide of the present apparatus has a multiple radius curvature. The primary carrier 110 may thus be comprised of three portions including an arcuately shaped upper approach portion 250, an arcuately shaped center, or load portion 252 and an arcuately shaped lower or exit portion 254. The arcuate shape of the upper approach portion is defined by a first radius of curvature 256. The arcuate shape of the center portion is defined by a second radius of curvature 258 while the arcuate shape of the lower or exit portion is defined by a third radius of curvature 260. Referring back to FIG. 4, each radius is defined, or circumscribed by centers 133 of rollers 134, such that the arcuate shapes of each portion of carrier 110 are defined by the centers 133 of rollers 134. FIG. 4 shows the approximate locations of each portion on the embodiment described herein.

The magnitude of the first and third radii will typically be smaller than the magnitude of the second radius and will generally be of equal magnitude. The shape of the primary carrier is such that as tubing 16 passes over the primary carrier and is directed into the coiled tubing injector apparatus therebelow minimal bending and stresses are placed on the tubing. Rather than forcing the tubing straight, the tubing guide of the present invention allows the residual, or natural curvature of the tubing to direct the tubing into the proper injection position.

Each of the three radii which define the separate arcuate portions of the primary carrier will be smaller than the natural radius of curvature of the tubing after it is spooled from the reel. The tubing will pass through the approach guide 130 and will pass between the secondary carrier and primary carrier. Specifically, the tubing will pass between the rollers 166 and 170 on the roller carrier and rollers 134 on the center portion of the primary carrier. Because the first and third radii are smaller than the second radius, the tubing will have minimal to no contact with the upper approach and exit portions of primary carrier 110. As the tubing passes between the roller carrier and the primary carrier, the tubing will be placed under some bending as it attempts to conform to the radius of the carrier in that area. However, the bending and the stresses will be minimal since the roller carrier pivots.

An offset contact point 271 is defined on the lower or exit portion of the tubing guide. Offset contact point 271 is defined on one of the rollers 134, designated as offset roller 270. The center of offset roller 270 may be designated by the numeral 269. Center 269 of roller 270 is offset a distance 227 from center line 226 of the coiled tubing injector apparatus therebelow. The offset 227 is such that as tubing 16 is directed downward, the natural curvature of the tubing will cause the tubing to traverse the lateral distance, or offset 227 between the offset roller and the center line of the coiled tubing injector as it passes through the vertical distance or height 229 from the center 269 of the offset roller to an engagement point 272 on the coiled tubing injector. The natural curvature of the tubing thus directs the tubing to its proper injection position.

Referring again to the schematic shown in FIG. 17, engagement point 272 is located at the top of the operating length of the linear or pressure beam of the coiled tubing injector apparatus. The operating length of the pressure beam is the portion of the beam along which the coiled tubing injector apparatus engages the tubing passing therethrough. Thus, the engagement point is located where the linear beam becomes substantially vertical, which is the point at which the coiled tubing injector apparatus will first engage outer diameter 17 of tubing 16.

As set forth previously, the invention described herein is not limited by the use of any particular coiled tubing injector apparatus. The offset 227 is such that the natural curvature of the tubing will cause the tubing to be substantially vertical when it reaches engagement point 272. Because of inconsistencies in the tubing and differing tubing sizes, the tubing may contact backup plates 160 and 162 and exit roller 163 as it passes through the tubing guide. However, the contact will simply direct the tubing and will apply very little bending or stress thereto. The offset 227 can be determined utilizing the equation:

$$offset = R - R\cos(arc\sin H/R)$$

where "R" is the natural radius of curvature of the tubing and "H" is the vertical distance 229 between the center of the offset roller and the engagement point.

For example, it has been determined that tubing having diameters from 1.25 to 2.325 have a natural, or residual radius of curvature of approximately 240 inches when they are spooled from a reel 18. Utilizing an approximate radius of 240 inches for the radius of curvature of the tubing, the position of the offset roller can be determined.

Referring again to the schematic shown in FIG. 17, the arc designated by the numeral 280 depicts a center line or longitudinal central axis of coiled tubing having a radius of curvature of 240 inches in its free state. The center line, or longitudinal central axis of tubing passing through an upper approach guide and being directed by the tubing guide of the present invention is, as set forth previously, designated by the numeral 15. Center line 15 will tend to follow, or approximate the natural curvature depicted by radius 280 after the tubing exits the roller carrier and passes over center portion 258 of the primary carrier. Thus the lines 15 and 280 are shown to be co-linear at that point.

As shown in FIG. 17, the tubing becomes substantially vertical at engagement point 272. An arc utilizing the radius of 240 inches can be used to identify and locate center 269 of offset roller 270 on the primary carrier. In the example shown, a 15° arc 267 is utilized. Obviously, the arc can vary from 15°. It simply must be great enough to identify a point on the primary carrier above the base. The arc is drawn from a line 266 that is perpendicular to center line 226 at engagement point 272. Thus, line 266 is the horizontal radius drawn through the engagement point. "H" which is the height, or length of a vertical line from center 269 down to line 266, can be analytically determined. In the example provided, the height is approximately 62.12 inches. Utilizing 62.12 as "H" in the equation set forth above, the offset 227 is determined to be approximately 8.18 inches. Having determined the offset, radius 260 of exit portion 254 may then be circumscribed through an arc so that at center 269 of roller 270, center line 280 of tubing in its free state and radius of curvature 260 are tangent. As shown in FIG. 17, if radius 260 is extended, it will intersect radius 266 at its point of origin 273. Radius of curvature 258 can be circumscribed through an arc to define the center, or load portion starting from the point where the exit portion ends. An arc may then be circumscribed utilizing radius 256 to define the upper portion.

As set forth above, radius of curvature 258 is greater than radii 260 or 256. In one embodiment, radius 260 may be equal to a radius of 72 inches circumscribed through an arc of 30°. The 72-inch radius defines the arcuate shape of the exit portion in the example provided herein, and is circumscribed, as set forth earlier, by the centers of the rollers on the primary carrier. The center portion may be defined by a 120-inch radius circumscribed through an arc of 30° and the upper or approach portion is defined by an arc of 72 inches circumscribed through an arc of 60°.

In operation, the tubing will pass through the approach guide and will be directed between the secondary carrier and the primary carrier. As it passes between the roller carrier and the primary carrier, the tubing will be forced slightly to conform to the radius 258 of center or load portion 252 of the primary carrier. Once the tubing passes through center portion 252 it will attempt to return to its natural radius of curvature. Thus, when the tubing is unrestricted, the position of center line 15 of the tubing will be approximately tangent to center 269 of roller 270, as it passes thereby.

Practically, center line 15 of tubing 16 will not be tangent to center line 280 at center 269 of roller 270, since outer diameter 17 of tubing 16 will contact the circumferential groove of offset roller 270 of contact point 271, thus preventing center line 15 from becoming tangent to center line 280 at that point. However, because the radius of curvature of exit portion 254 is less than the natural radius of curvature of the tubing, the tubing will be unrestricted once it passes roller 270 and will continue to return to its natural radius, as depicted by center line 280. Thus, as tubing 16 travels through the vertical distance or height 229, it will traverse the lateral offset 227, and will be in the proper, or substantially vertical injection position when it reaches engagement point 272. The amount of contact with offset roller 270 at contact point 271 will vary because of variations in tubing size, inconsistencies in tubing, manufacturing tolerances and other factors. Further, as will be recognized by those in the art, the actual point of contact will be different for different tubing diameters. However, by determining the approximate natural radius of curvature of tubing 16, and by using the center line of the tubing to locate the center of the offset roller, it can be insured that the position of the tubing as it passes the offset contact point is such that the natural radius of curvature of the tubing will direct the tubing toward the proper injection position. In addition to contact with the offset roller 270, the tubing may slightly contact backup plate 162 or exit roller 163. However, the contact will be minimal, and will act to guide and direct the tubing, rather than to apply high bending or stresses. The life of the tubing can therefore be extended beyond what would be possible with prior art tubing guides.

The center line 15 of the tubing as it passes over offset roller 270 will be at an angle 261 to the vertical, and thus will be at an angle to the center line 226 of the coiled tubing injector apparatus and the well therebelow. The natural curvature of the tubing is such that as the tubing passes through the vertical distance to the engagement point, it will traverse the offset, and will become substantially vertical by the time it reaches engagement point 272. Center line 15 of the tubing will be substantially vertical when it reaches engagement point 272. Likewise, a line 268 tangent to the tubing at engagement point 272 is substantially vertical and thus substantially parallel to center line 226 of the coiled tubing injector apparatus. The tubing can therefore be easily stubbed, since it is substantially vertical and in the proper injection position when it reaches the engagement point.

Clearly, the example set forth herein is simply intended as an example and is not in any way intended to limit the invention described and claimed herein. The equations set forth herein will allow the determination of the offset which is required between the engagement point, which is a defined point, and the center of an offset roller located on the tubing guide. The magnitude of the multiple radii which circumscribe the portions of the primary carrier are not limited to the examples set forth herein.

It has been shown that the improved tubing guide of this invention fulfills all objects set forth hereinabove and provides distinct advantages over the known prior art. It is understood that the foregoing description of the invention and illustrative drawings which accompany the same are presented by way of explanation only and that changes may be had by those skilled in the art without departing from the true spirit of this invention.

What is claimed is:

1. A tubing guide for directing coiled tubing into a coiled tubing injector apparatus comprising:

a base positioned over said coiled tubing injector apparatus; and a curvilinear primary carrier attached to and extending from said base capable of directing coiled tubing through said base and into said coiled tubing injector apparatus, said curvilinear primary carrier being defined by a plurality of arcuately shaped portions, said portions being defined by more than one radius of curvature.

2. The tubing guide of claim 1 wherein said primary carrier further comprises:

an arcuately shaped upper approach portion having a first radius of curvature;

an arcuately shaped center portion having a second radius of curvature; and an arcuately shaped lower exit portion having a third radius of curvature.

3. The tubing guide of claim 2 wherein said second radius of curvature is of greater magnitude than said first and third radius of curvature.

4. The tubing guide of claim 2 wherein said first and third radius of curvature are of equal magnitude.

5. The tubing guide of claim 4 wherein said second radius of curvature is greater than said first and third radius of curvature.

6. The tubing guide of claim 1, wherein said primary carrier comprises:

a primary carrier arm; and a plurality of rollers attached to said primary carrier arm.

7. The tubing guide of claim 6 further comprising:

a secondary carrier positioned over said primary carrier, said secondary carrier having a roller carrier disposed therein, said roller carrier having a plurality of rollers attached thereto for accommodating coiled tubing passing between said roller carrier and said primary carrier.

8. The tubing guide of claim 7 wherein said roller carrier is pivotally attached to said secondary carrier.

9. The tubing guide of claim 1, said primary carrier having an offset roller positioned above said base, thereby allowing coiled tubing to be laterally offset from a centerline of said coiled tubing injector apparatus upon tubing passing over said offset roller.

10. The tubing guide of claim 9, said offset roller being displaced a vertical distance from an engagement point defined on said coiled tubing injector apparatus, for accommodating tubing having a natural radius of curvature allowing tubing to traverse said lateral offset upon tubing passing through said vertical distance so that tubing is substantially centered over said centerline of said coiled tubing injector apparatus when it reaches said engagement point.

11. The tubing guide of claim 9, wherein said offset roller is displaced a vertical distance from an engagement point defined on said coiled tubing injector apparatus, for accommodating a tubing having a longitudinal central axis, said longitudinal central axis of said tubing being at an angle from said center line of said coiled tubing injector apparatus as said tubing passes over said offset roller, wherein said tubing has a natural radius of curvature such that said longitudinal central axis of said tubing is substantially vertical when said tubing reaches said engagement point.

12. A tubing guide for directing coiled tubing having a natural radius of curvature into a coiled tubing injector apparatus positioned above a wellbore comprising:

a base;

a primary tubing carrier extending from said base, said primary tubing carrier having an offset roller located above said base, thereby allowing coiled tubing to pass over said offset roller, through said base and into said coiled tubing injector apparatus, said coiled tubing injector apparatus having an initial engagement point wherein tubing can first engage said coiled tubing injector apparatus and be laterally offset from said engagement point upon tubing passing over said offset roller, and wherein tubing having a natural radius of curvature a lateral offset as it passes through a vertical distance between said offset roller and said engagement point.

13. The tubing guide of claim 12, said coiled tubing injector apparatus having a longitudinal central axis and being able to accommodate tubing having a longitudinal central axis which is at an angle from said longitudinal central axis of said coiled tubing apparatus thereby allowing tubing to pass over said offset roller substantially parallel to said axis of said injector apparatus, upon tubing reaching said engagement point.

14. The tubing guide of claim 12 wherein said primary tubing carrier is comprised of:

a curvilinear primary carrier arm; and a plurality of rollers attached to said primary carrier arm, said offset roller comprising one of said plurality of rollers.

15. The tubing guide of claim 14, wherein said primary carrier arm is defined by a plurality of arcuately shaped portions.

16. The tubing guide of claim 15, wherein said plurality of arcuately shaped portions comprises an approach portion, a center portion and an exit portion, and wherein said arcuately shaped center portion is defined by a radius having a greater magnitude than the radii defining said approach and said exit portions.

17. A tubing guide for guiding coiled tubing into a coiled tubing injector apparatus comprising:

a base positioned above said coiled tubing injector;

a primary tubing carrier extending from said base allowing coiled tubing to pass over said primary tubing carrier and through said base into said coiled tubing injector apparatus; and a backup carrier extending from said base, said backup carrier having a pivotable roller carrier positioned above said primary carrier disposed therein wherein tubing can pass between said pivotable roller carrier and said primary carrier.

18. The tubing guide of claim 17 wherein said pivotable roller carrier comprises a center roller and a plurality of outer rollers, said roller carrier being pivotable about said center roller.

19. The tubing guide of claim 18 wherein said primary carrier is comprised of three arcuately shaped portions, including an upper approach portion, a center portion and an exit portion, said roller carrier being located over said center portion.

20. The tubing guide of claim 19 wherein said upper approach portion is defined by a first radius of curvature, said center portion is defined by a second radius of curvature and said third portion is defined by a third radius of curvature, said second radius of curvature having a magnitude greater than said first and third radius of curvature.

21. The tubing guide of claim 17 further comprising:

a plurality of rollers attached to said primary carrier, wherein one of said rollers comprises an offset roller, said offset roller being laterally offset from a center line of said coiled tubing injector apparatus thereby allowing tubing having a natural radius of curvature to traverse said lateral offset upon passing through a vertical distance from said offset roller to an engagement point defined on said coiled tubing injector apparatus.

* * * * *